United States Patent [19]

Lay

[11] Patent Number: 4,938,478

[45] Date of Patent: Jul. 3, 1990

[54] BALL HITTING PRACTICE DEVICE

[76] Inventor: William C. Lay, 931 Creek Hill Land, Midvale, Utah 84047

[21] Appl. No.: 435,059

[22] Filed: Nov. 13, 1989

Related U.S. Application Data

[63] Continuation-in-part of Ser. No. 162,213, Feb. 29, 1988.

[51] Int. Cl.[5] ..... A63B 69/00

[52] U.S. Cl. ..... 273/26 R

[58] Field of Search ..... 273/26 R, 29 R, 29 A, 273/DIG. 21, 26 E; 272/78

[56] References Cited

U.S. PATENT DOCUMENTS

| | | | |
|---|---|---|---|
| 519,918 | 5/1894 | Mac Lean | 272/78 |
| 2,186,403 | 1/1940 | Bullis et al. | 272/78 |
| 2,444,999 | 7/1948 | Natchuk | 273/30 |
| 2,713,487 | 7/1955 | Jaediker | 273/29 A |
| 3,039,770 | 6/1962 | Ferretti | 273/207 |
| 3,139,282 | 6/1964 | Lande | 273/26 R |
| 3,166,316 | 1/1965 | O'Leary | 273/DIG. 7 |
| 3,183,000 | 5/1965 | Dix | 273/26 R |
| 3,883,138 | 5/1975 | Chorey | 273/26 R |
| 3,967,822 | 7/1976 | Candor et al. | 273/26 R |
| 4,417,730 | 11/1983 | Weiner | 273/29 A |
| 4,531,734 | 7/1985 | Herrick | 273/29 A |

FOREIGN PATENT DOCUMENTS

| | | | |
|---|---|---|---|
| 718287 | 5/1925 | France | 273/207 |
| 505980 | 10/1951 | France | 272/78 |
| 2548914 | 1/1985 | France | 273/29 A |

OTHER PUBLICATIONS

Popular Science, Mar. 1959, p. 183.

*Primary Examiner*—T. Brown

[57] ABSTRACT

A ball hitting practice device comprising a planar base, a vertical pedistal of an longated flexible first member having a specially prepared molded ball fixedly attached to the terminal end and the other end being telescopically inserted into a second elongated rigid tubular member, a safety lock at the end of the first member to prevent it from being removed from the top of the second member, an adjustable lock on the first and second members adapted to secure the first member at the desired height, and a coil spring the top end of which is fixedly attached to the bottom of the second member and the bottom end being fixedly attached by a bolt to the planar base.

7 Claims, 2 Drawing Sheets

BALL HITTING PRACTICE DEVICE

This invention is a continuation-in-part of my patent application Ser. No. 162,213, filed Feb. 29, 1988.

BACKGROUND OF THE INVENTION

1. Field of the Invention

This invention relates to a new practice batting or hitting device. More particularly, the invention relates to a baseball or softball practice hitting device that avoids the necessity of retrieving the ball after the practice swing.

Specifically, the invention provides a new type of baseball and softball practice hitting device that is ideal for use in training young ball players in that it avoids the necessity of retrieving the ball after the practice swing and can be made adjustable to fit all ages of player. The new practice hitting device broadly comprises in combination a planar base adapted to being secured to a solid surface, a vertical pedistal the height of which is that needed to hold a baseball or softball at the top thereof for ball practice, said pedistal comprising an elongated flexible first member having a specially prepared molded baseball or softball fixedly attached to the terminal end thereof and the other end being telescopically inserted into a second elongated rigid tubular member, a safety lock means at the end of the first member to prevent it from being removed from the top of the second member, adjustable locking means on the first and second members adapted to secure the first member at the desired hitting height, and a coil spring the top end of which is fixedly attached to the bottom of the second member and the bottom end being fixedly attached by bolt means to the planar base.

2. Prior Art

In the game of baseball, one of the most difficult skills to master is hitting. First, a hitter must be able to coordinate the swing of a bat with the location of a ball so that good contact with the ball can be made while swinging the bat. Once this is mastered, the hitter must next learn to make good contact with the ball at the various positions at which it may cross home plate, from an inside pitch to an outside pitch, and from a high pitch to a low pitch, and various combinations of these two variables.

In development of these skills, the trainer or coach uses a baseball tee to support a ball at a selected height above a representation of the baseball home plate. The player then hits the ball out to the field, the ball is retrieved and placed on the tee for another swing. In this manner, the player can practice swinging and improve the coordination of his hands and eyes and develop his wrist and arm muscles.

Various practice batting tees have been developed in the past for this purpose. The practice tees developed to date, however, have had various limitations which have discouraged their overall acceptance in the baseball world.

In most cases, the ball is positioned on the tee and hit out into the field. This requires someone to retrieve the ball for the next hit. This has become very tiring work and discouraging to some players. In other cases, the tees have not been adjustable and different tees must be used for different hitting zones. In other cases the tees have been partially adjustable, but not able to cover all the hitting zones. In some cases, the tees have been adjustable, but the adjustment has required considerable time and manipulation to obtain a tee in the desired position In other cases, the tees have been very expensive to produce, and the cost has been prohibitive for many of the smaller teams.

Following are examples of the prior art which disclose many of the tees having the above-noted limitations. U.S. Pat. Nos. 4,383,686, 4,277,691, 4,516,771, 2,862,712, 4,508,340, 3,877,695, 2,616,692 and 3,489,411.

The following patents disclose practice hitting devices wherein the ball is attached to a string and can be hit again when the string stops swinging or is retrieved: U.S. Pat. Nos. 4,050,694, 3,885,790, 3,716,235, 3,623,725. U.S. Pat. No. 3,794,320 discloses a device wherein the ball is attached to an arm which rotates 90 degres, but is unable to be adjusted to various types of pitches.

French patent No. 505,980 discloses a punching bag device wherein the punching bag is fixedly attached to an upright pedistal. While this is satisfactory for the strikes of a fist, it is entirely unable to withstand the powerful strike of a baseball bat and is snapped after the first strikes.

My U.S. Pat. No. 4,681,318 discloses an improved practice batting tee having a special ball joint at the bottom of the pedistal which sometimes adds control problems. In addition, it has been found that after periods of use the ball as shown in that patent is torn off, and/or the vertical pedistal is snapped off. As a result, such defects have limited the use of such baseball tees.

It is an object of the invention, therefore, to provide a new practice hitting device for baseball and softball which corrects many of the above-described limitations. It is a further object to provide a practice hitting device which avoids the necessity of retrieving the ball after being hit. It is a further object to provide an adjustable practice hitting device which can be adjusted according to the height of the batter. It is a further object to provide a new adjustable hitting device which can be produced at low cost and can be made available to all softball and baseball teams. It is a further object to provide a new practice hitting device that can be used indoors as well as outdoors. These and other objects of the invention will be apparent from the following detailed description thereof.

SUMMARY OF THE INVENTION

It has now been discovered that these and other objects may be accomplished by the new adjustable practice hitting device of the present invention which presents for the first time an efficient and economical way for the training of young batters in all aspects of the hitting techniques.

The new practice hitting device of the present invention broadly comprises in combination a planar base adapted to resting on a solid surface, a vertical pedistal the height of which is that needed to hold a baseball or softball at the top thereof for ball practice, said pedistal comprising an elongated flexible first member having a specially prepared molded polyurethane baseball or softball fixedly attached to the terminal end thereof with the molding extending down along the sides of the first member and the other end being telescopically inserted into a second elongated rigid tubular member, a plastic washer means between the first and second members at the top of the second member to help absorb the shock when hit, a safety lock means at the end of the first member to prevent it from being removed from the top of the second member, adjustable locking means on the first and second members adapted to secure the first member at the desired hitting height, and a coil spring the top end of which is fixedly attached to the bottom of the second member and the bottom end being fixedly attached by bolt means to the planar base.

it has been surprisingly found that the new practice batting device described above solves many of the defects noted for the prior art devices. The new practice batting device, for example, avoids the necessity of retrieving the ball after the practice swing as the ball is firmly attached to the pedistal. After the ball has been hit, the pedistal bends forward and then quickly recovers its original position as a result of the coil spring at the base of the pedistal. This unique property is particularly important because it also permits the batting tee to be used indoors during the early cold days of spring practice when batting practice outdoors would be undesirable. Furthermore, the new device is easily adjusted to the desired height for the individual batter by lowering or raising the first resilient member.

The special advantage, however, is that the new device solves the problem of the prior tees with attached balls in that it does not break after repeated striking of the ball or the tee with the baseball bat. The use of the unique molded polyurethane ball as well as the use of the special plastic washer and other unique features gives the tee a surprising stability to constant striking of the ball and tee structure. This was quite unexpected because after using a variety of material for construction of the tee it was thought that nothing could be found which would withstand the striking by the ball.

Further advantage is found in the fact that the new features are inexpensive and easy to construct so that the new tees can be produced at a cost where the device can be available for all coaches and trainers of the young ball players.

DESCRIPTION OF THE DRAWINGS

The various objects and features of the present invention will be more fully understood by reference to the accompanying drawings.

With reference to FIG. 1, the assembled practice batting tee is shown as 11, the first flexible elongated member as 17, the molded polyurethane ball fixedly attached to the first member as 14A with the bottom extension covering the first member as 14, the second rigid elongated member as 12, attached to coil spring 13 which in turn is attached by bolt means 18A to planar base 18. The thin layer of plastic on the outside of the first vertical member is shown as 17A, the plastic washer between the first and second member is shown as 16, the holes or apertures for insertion of the locking means are shown as 15. The apertures or holes for placing of stakes to secure the plate to the ground are shown as 19.

With reference to FIG. 2 which is a cutaway front view of the top portion of the batting tee showing how the first member is inserted up into the center of the ball and the molded ball extends down along the side of the vertical member. The elongated flexible member is shown as 17, the plastic coating on the outside of the member as 17A, the molded ball is shown as 14A and the side of the molding coming down over the vertical member is shown as 14.

With reference to FIG. 3 which is a cutaway front view of the second vertical member with the first member inserted within the second member, the first flexible member is shown as 17, the plastic coating on the outside of the first member is shown as 17A. The safety means at the end of the first member to prevent it being pulled out of the tubular second member is shown as 20 with the locking hole in that member as 20A. The plastic washer threaded into the top inside of the second member to assist in absorbing the shock on hitting use of the tee is shown as 16, with the threaded portion of the second member as 16A. The holes in the second member for the insertion of the locking pins are shown as 15.

With reference to FIG. 4 which is a cutaway front view of the coil spring showing the connection with the second vertical member and the bolt means for attachment to the base, the vertical member is shown as 12, the coil spring as 13, the spot weldings to hold vertical member 12 to the springs is shown as 21, the bolt at the bottom of the spring to be bolted to the base plate is shown as 22.

With reference to FIG. 5 which is a typical locking pin to be inserted in the holes of the second vertical member to hold the first member in proper place is shown as 25, with handle ring 25A.

DETAILED DESCRIPTION OF THE INVENTION

Figure 1:
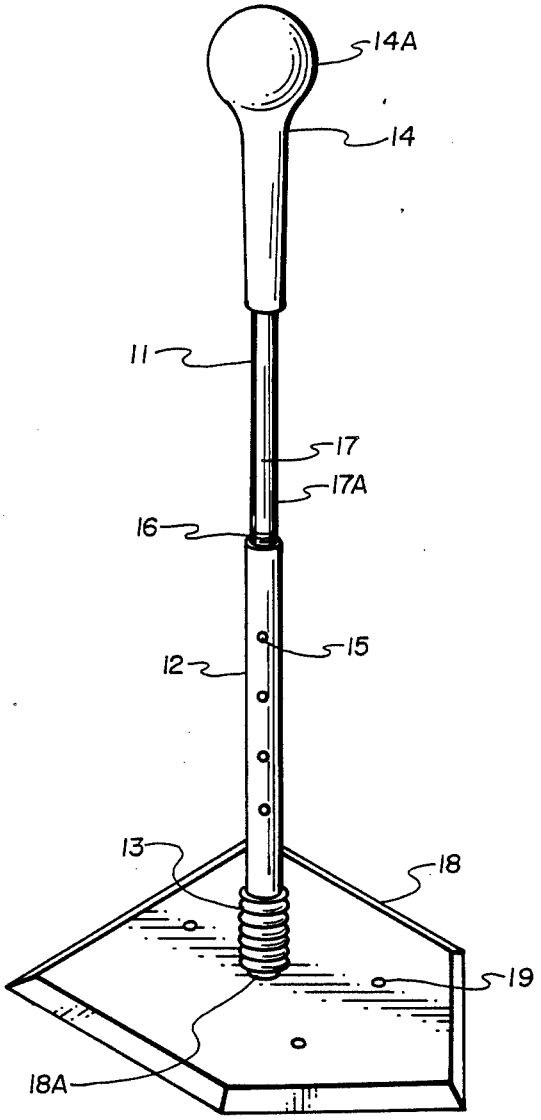
FIG. 1 is a front view of the batting tee as assembled.

While the above-described description of the invention and drawings have been made in rather specific terms, it should be understood that various changes can be made in construction and operation without departing from the scope of the invention.

The planar base for the hitting device can be of any desired shape or size, and of any suitable material as long as it provides the base for the attachment of the upright pedistal and holding of the pedistal in an upright position. In general, the base is of the conventional baseball shape and is made from strong rubber. The conventional shape of the baseball plate 17″×17″ is preferably white so it can be easily seen.

As noted, the planar plate base should be secured to a solid surface so that the pedistal can swing back after the ball has been hit. The plate base can be secured to such a surface, as the ground, by any suitable means. Preferably the base is secured by the insertion of several long pins through holes in the plate as shown by 14 of the drawing. One preferably employs at least two and generally from 2 to 4 such pins to hold the plate on the desired surface. Such pins are preferably prepared from metal, such as iron or steel.

If the hitting device is to be used indoors, such as on a gym floor or carpeted area, the base can be held down by the addition of weights or other means to hold the plate firmly on the surface so that the device will not move when the ball is hit.

As shown, the ball for which training is desired is fixedly attached to the top terminal end of the first elongated flexible member. The ball is one that has been molded from polyurethane and is molded such that the bottom side of the ball extends down around the out-sides of the elongated flexible member as shown in the drawings. The molding preferably extends down about 7 to 9 inches around the first member and preferably has a thickness of about ¼ to ⅞ inches.

It should be noted that the use of balls prepared from rubber have not been successful as the balls are easily snapped or cut by the striking. It was quite surprising to find that the molded polyurethane balls could withstand the forces applied to the ball without snapping or being cut.

The molded ball should be such that it fits very tightly over the upright member, but in some cases it may be useful to adhere the molding to the upright by the use of adhesives and the like.

The ball may be of any shape and size as long as it provides the necessary extension to cover the top part of the first vertical member of the tee. Preferably the ball is a baseball or softball in shape.

As noted, the ball is attached to the terminal end of the first vertical member. This member is made of flexible material, and is preferably a solid fiber glass rod. The diameter and height of the first member can vary as desired. In general, the first member will have a diameter varying from about ¼ to ¾ inches and preferably from ⅜ to ½ inches. The first member can also preferably be smaller at the top than at the bottom as in a tapered fashion. The length of the first member as it goes from the insert of the ball to slide within the second member generally varies from 18 to 25 inches.

In order to provide necessary protection from shock when the ball is hit, a thin coating of a special plastic, such polycarbonate, is applied to the outside of the first member all along the length thereof. The coating is preferably from 1/32 to ¼ inches in thickness, and more preferably 1/16 inches in thickness.

The top end of the first member extends up into the molded ball section, and preferably up to at least the center of the ball. As noted, the molded ball section preferably extends down over the first member for about 4 to 5 inches and fits snugly around the top of the first member.

Figure 3:
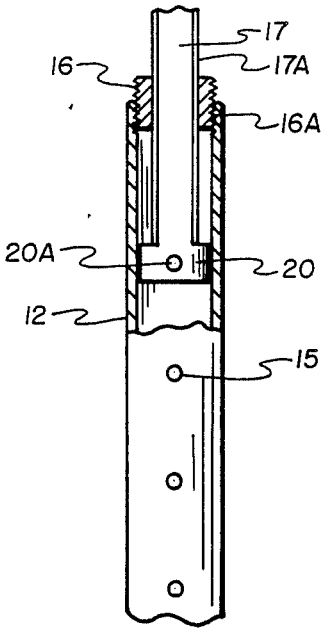
FIG. 3 is a cutaway front view of the end of the first member being inserted at the top of the second vertical member.

The bottom end of the first member fits into the top of the second tubular member and possesses a safety means to prevent the first member from being pulled out of the second tubular member. This is generally accomplished by having an enlarged section at the bottom end of the first member which is larger than the closed off top of the tubular member. As shown in FIG. 3, the bottom end has an enlarged section about ¾ inches in thickness which fits snugly against the inner sides of the second member and when the first member is pulled upward it is stopped by the plastic plug in the top end of the second member.

The second elongated vertical member is a rigid tubular material having an opening sufficiently large to permit the first member to telescopically fit therein. The second member is preferably prepared from rigid tubular material, such as a metal tube of inside diameter varying from about ⅝ to ⅞ inches and preferably ¾ inches in diameter. The exact inside diameter being such as to permit the first member to slip past the washer and have a locking means at the end. The length of the second member is such as to permit the first member to be adjusted up and down and to present the proper height for the small ball players. In general, the height varies from about 16 to 24 inches.

The side of the second vertical member has a series of holes spaced along the side to assist in the adjustment of the height of the tee. 4 to 6 holes are preferably spaced apart about 2 to 3 inches and have a diameter sufficient to permit the locking pin to he inserted. The holes are aligned with the hole of similar diameter in the safety end of the first member.

A plastic washer means, preferably prepared from nylon or polycarbonate, is inserted between the first and second member at the top of the second member to help absorb the shock when the tee is hit. The washer is preferably about ¾ to 1½ inches in length and the outside of the washer as well as the inside of the top of the second member are threaded so that the washer can be removed as needed to allow the first member to be removed.

The end of the second member is fixedly attached to the top of a coil spring. The coil spring is preferably prepared from iron or steel and made from tightly wound metal wire of preferably about ⅛ to ⅜ inches in diameter. The length of the coil may vary as desired, but is preferably from about 3 to 6 inches in length. The coil spring should obviously be of such strength that it can rapidly bring the pedistal back to its original place after the bat has hit the ball.

The end of the second member can be fixedly attached to the top of the coil spring by any suitable means. Experience has shown that it is best attached by spot welding the end of the second member to the top edge of the coil spring.

Figure 4:
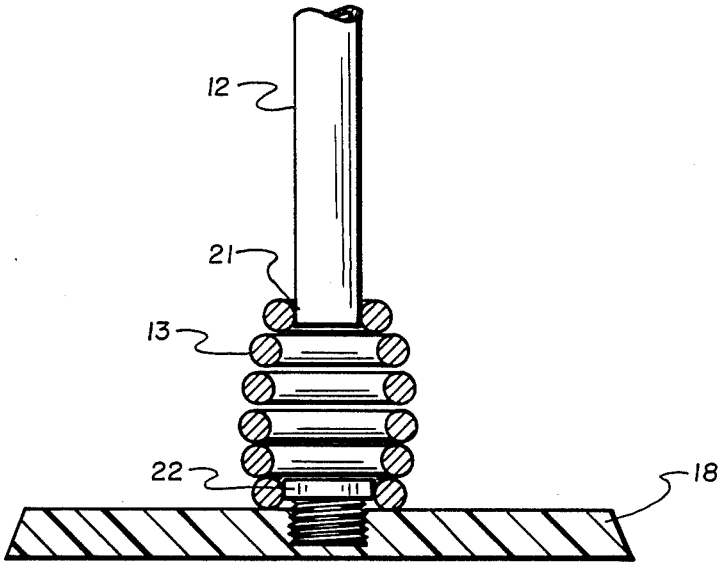
FIG. 4 is a cutaway front view of the second member as it is joined to the top of the coil spring and the bottom of the coil spring bolted to the planar base.
Figure 5:
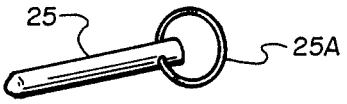
FIG. 5 is an illustration of a locking pin that can be used to lock the first member to the second member in making the proper adjustment of the tee.

The bottom of the coil spring is fixedly attached to the planar base by bolt means. Other means of attachment, such as welding, are not satisfactory because of the great strain that is exerted against the pedistal when the ball is hit. The bolt can be placed at the end of the spring as shown in FIG. 4, and then screwed into the threaded opening in the top of the planar base.

The device of the present invention may be utilized in a variety of different ways depending on the need for instruction in batting practice As noted, the device can be used for batting practice for baseball or for softball or for any other game involving the hitting of a ball with a bat or racket.

For hitting balls of average height one would preferably use a device as shown with the pedistal being about 29 to 35 inches high. In the event practice is needed for hitting low balls, one may lower the height of the pedistal to about 20 to 29 inches.

The device is operated in most cases by placing the plate or base on the ground or other solid surface and securing it to the same. If the ball has not already been attached as by molding or by adhesive, tape, etc., the ball can then be fixedly attached to the top of the pedistal. The batter can then take his position and swing at the ball. On contact the ball and attached pedistal is bent forward, but then rapidly recovers its original position because of the coil spring at the base of the pedistal. The ball is then in position to be hit again.

PREFERRED EMBODIMENT OF THE INVENTION

A preferred embodiment of the invention is described below. It should be understood, however, that this is given as a preferred assembly of apparatus for certain training schedules and is not to be regarded as limiting the invention in any way.

Figure 2:
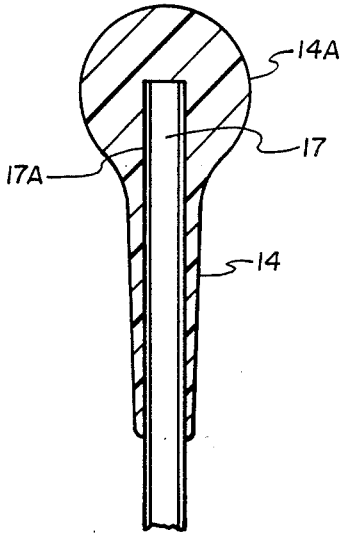
FIG. 2 is a front cutaway view of the molded polyurethane ball as it is placed on the first vertical member.

The preferred apparatus was prepared as follows: A baseball casting of the shape shown in FIG. 2 was molded from polyurethane. The bottom section of the baseball extended down approximately 7 inches so that it could cover a portion of the outer surface of the first member.

A first vertical member was prepared from solid fiber glass rod of about ½ inches in diameter and about 18 inches in length. The outside of the fiber glass rod was coated with a 1/16 inch coating of polycarbonate along the length to help aborb shock. The bottom end of the vertical member was enlarged to fit snuggly inside the second vertical member as noted below. A ¼ inch hole was placed in the enlarged section so that it could be aligned with the holes in the second vertical member and thus lock the two members together.

A second vertical member was prepared from metal tubing having inside diameter of ¾ inch and a length of about 18 inches. The top inside of the tubing was threaded so as to receive a nylon plastic washer to be placed therein as noted below. Spaced openings of about ¼ inch in diameter were then placed on the outside of the second member so that they could be aligned with the hole at the bottom of the first member.

The bottom of the second member was then fixedly attached to the top of a heavy duty coil spring. The coil spring about 5 inches in height was prepared from coiled metal wire of about ⅜ inches in diameter. The bottom of the second member was joined to the top of the coil spring by spot welding.

A base plate 17 inches by 17 inches was injected molded from hard polybutadiene rubber. Three holes were spaced on the plate to permit the plate to be attached to the ground or other solid surface. The coil spring was attached to the center of the base plate by bolt means. A ⅝ inch bolt was placed at the bottom of the coil spring and retain there by the sides of the spring which were smaller than the head of the bolt. The threaded section of the bolt was then threadedly engaged in the opening in the base plate.

The apparatus prepared as above was then used for batting practice. The tee was placed on the ground and secured by spikes driven into the ground through the openings in the plate. The pedistal was then adjusted to the height of the batter by aligning the hole in the second member with the hole in the bottom of the first member and then placing a locking pin through the hole. The batter was then allowed to strike the ball from the batting practice. Each time the pedistal quickly returned to its proper place and was ready for the next batter to swing. The need for recovery of the ball was thus eliminated and the batter was able to practice for a great length of time and the elimination of the task for retrieving the ball was greatly appreciated.

I claim as my invention:

1. A baseball or softball practice hitting device comprising in combination a planar base adapted to resting on a solid surface, a vertical pedistal having its lower end attached to said base said pedistal comprising a first elongated flexible member and a second elongated rigid tubular member; said first member having a specially prepared molded polyurethane baseball or softball fixedly attached at one end thereof said molded polyurethane extending down along the sides of the first member and its other end being telescopically inserted into the top of said second elongated rigid tubular member, a washer means between the first and second members at the upper end of said second member, a safety lock means at said other end of the first member to prevent it from being removed from the top of the second member, adjustable locking means on the first and second members for securing said first member at a desired hitting height, and a coil spring having one of its end fixedly attached to the bottom of the second member and its other end being fixedly attached by bolt mean to the planar base.

2. A device as in claim 1 wherein the first member possesses a thin coating of plastic on the outside surface thereof.

3. A device as in claim 1 wherein the first member extends up into the molded polyurethane ball to about the center of the said ball.

4. A device as in claim 1 wherein the washer is prepared from nylon plastic.

5. A device as in claim 1 wherein the first member is coated with a thin coating of polycarbonate.

6. A device as in claim 1 wherein the first member is prepared from fiber glass rod.

7. A device as in claim 1 wherein the second member is a metal tubing.

* * * * *